8/31/82 OR 4,346,780 SR

United States Patent [19]

Packschies et al.

[11] 4,346,780

[45] Aug. 31, 1982

[54] PURGING PIPES UNDER NOISE-ATTENUATING CONDITIONS

[75] Inventors: Heinz Packschies, Mülheim; Wilhelm Feldman, Duisburg; Albert Hankel, Essen, all of Fed. Rep. of Germany

[73] Assignee: Mannesmann Aktiengesellschaft, Düsseldorf, Fed. Rep. of Germany

[21] Appl. No.: 282,170

[22] Filed: Jul. 10, 1981

[30] Foreign Application Priority Data

Jul. 17, 1980 [DE] Fed. Rep. of Germany ..... 3027387

[51] Int. Cl.[3] ..... G10K 11/00; F01N 5/00

[52] U.S. Cl. ..... 181/198; 181/211

[58] Field of Search ..... 181/175, 198, 200, 205, 181/211, 212, 224; 285/9 R, 18

[56] References Cited

FOREIGN PATENT DOCUMENTS 2444944 12/1977 Fed. Rep. of Germany .

2810493 10/1980 Fed. Rep. of Germany .

*Primary Examiner*—Richard A. Wintercorn
*Assistant Examiner*—Thomas H. Tarcza
*Attorney, Agent, or Firm*—Ralf H. Siegemund

[57] ABSTRACT

Noise attenuation during the purging of pipes by means of steam blowing is achieved by the use of a receptacle into which steam is blown upon discharge from one end of a pipe; a linkage pivotally suspends an exchangeable mouthpiece adjacent to a front end opening of the receptacle and carries a stop member; actuation of the linkage places the mouthpiece over a front end of the pipe adjacent to said opening while removing said stop and, alternatively, places the mouthpiece over a front end of the pipe adjacent to said opening while removing said stop and, alternatively, pivots the mouthpiece to clear the pipe while causing the stop member to be placed in front of that front end.

2 Claims, 2 Drawing Figures

PURGING PIPES UNDER NOISE-ATTENUATING CONDITIONS

BACKGROUND OF THE INVENTION

The present invention relates to improvements in equipment provided for purging pipes such as zinc-plated pipes or tubes by means of blowing through steam. Equipment of the type to which the invention pertains includes, for instance, an exhaust fan device for sucking injected steam out of such a pipe. This device includes, in particular, an enclosure into which the steam is blown from the pipe, and the exhaust fan sucks the steam out of the enclosure. The purpose of such an equipment is to purge the interior of the pipe after it has left a zinc-plating bath by means of steam. See, e.g., German Pat. No. 24 44 944; this patent discloses such purging procedure under noise-attenuating conditions. Noise attenuation has been made known also by German Pat. No. 28 10 493, wherein an enclosure is provided and which includes a pivotable stop for the pipe as well as a closing structure which matches the opening to the outer diameter of the pipe passing through.

DESCRIPTION OF THE INVENTION

It is an object of the present invention to improve the equipment used for attenuating the noise that is produced when the interior of a pipe is purged of its fumes as they may develop, e.g., on zinc-plating.

It is a specific object of the present invention to improve a noise-attenuating assessory used in equipment for purging pipes or tubes of internal vapors, the assessory including a receptacle with a front end opening and into which the purge-blowing gas, e.g. steam, is discharged and from which the discharge is exhausted.

In accordance with the preferred embodiment of the present invention, it is suggested to provide an improvement as per the specific object to be comprised of a, preferably, exchangeable mouthpiece suspended from a linkage to which is further connected linkage for a stop member. The linkage is actuated in that normally the mouthpiece is deflected and the stop member blocks the passage of a tube or pipe more toward the opening in the receptacle. Upon actuation, after a tube or pipe has arrived, the mouthpiece is slipped over the front end of the tube or pipe and the stop member is retracted. The mouthpiece, the various linkage members, and the actuator are preferably mounted on a common frame which can be slipped onto the receptacle and held thereon by a pin slot arrangement.

Aside from the advantages of the invention regarding noise attenuation and handling, it was found that zinc-plating time is actually reduced if the purging is used for the removable zinc-plating vapors. Moreover, the construction is simple, easy to maintain, and requires less frequent repairs so that the overall operation of the equipment is improved.

DESCRIPTION OF THE DRAWINGS

While the specification concludes with claims, particularly pointing out and distinctly claiming the subject matter which is regarded as the invention, it is believed that the invention, the objects and features of the invention, and further objects, features, and advantages thereof, will be better understood from the following description taken in connection with the accompanying drawings, in which

Figure 1:
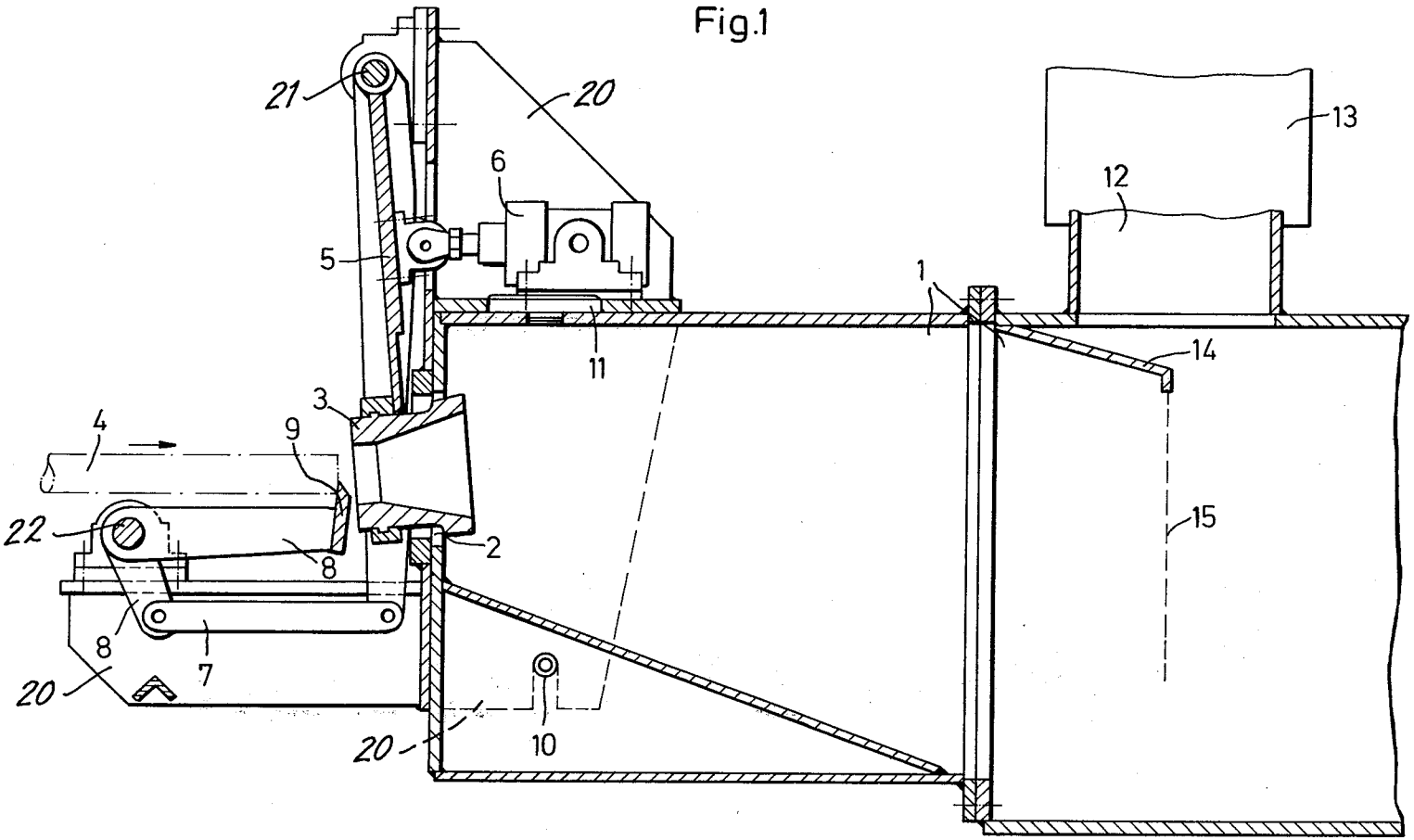
FIG. 1 is a cross section through a device constructed in accordance with the preferred embodiment of the invention for practicing the best mode thereof, the device being shown in a waiting state.

Proceeding now to the detailed description of the drawings, the figures illustrate a receiving receptacle 1 being constructed from two bolted-together portions 1*a* and 1*b*, of which 1*a* is the receiving receptacle proper and 1*b* is a portion of the exhaust chamber. The receiving receptacle 1*a* is provided with an entrance opening 2 which accommodates a telescoping, pivotable mouthpiece 3.

The mouthpiece 3 is connected to a rod and lever linkage 5 which, in turn, connects the mouthpiece to the cylinder of a hydraulic drive and actuator 6. One end of a linkage lever or rod 7 is connected to an extension of linkage 5, while the other end of rod or lever 7 is connected to an angle lever 8. Lever 8 establishes further linkage and carries a stop 9.

Reference numeral 20 refers to a frame which (a) carries the drive 6; (b) provides a journal support 21 for the linkage 5; (c) carries a journal and bearings 22 for the angle lever 8. The receptacle 1 (1*a*) is provided with two pins; only one, pin 10, is shown, the other one is situated on the other side of the receptacle 1*a* and in alignment with the illustrated pin 10 along a line transversely to the plane of the drawings. The top of the receptacle carries another in pin, 11. The frame 20 is constructed in shroud-like fashion, the sides having slots to receive the pins such as 10. A central bore in a flat transverse portion of frame 20 receives pin 11. It can thus be seen that the frame 20 with appended parts (1 to 3 and 5 to 9) can just be slipped onto receptacle 1*a;* further connections are not necessary.

The portion 1*b* of receptacle 1 is further provided with a deflection sheet 14, and, for instance, a flexible curtain 15 is suspended from that sheet. Receptacle portion 1*b* is further provided with an opening duct 12 covered by a noise attenuator.

The mouthpiece 3 has a relatively short cylindrical opening 31 from which extends a flaring portion 32. This mouthpiece 3 is removable from its suspension in linkage 5 so that different mouthpieces can be used for the purpose of adaptation to different tube sizes.

Figure 2:
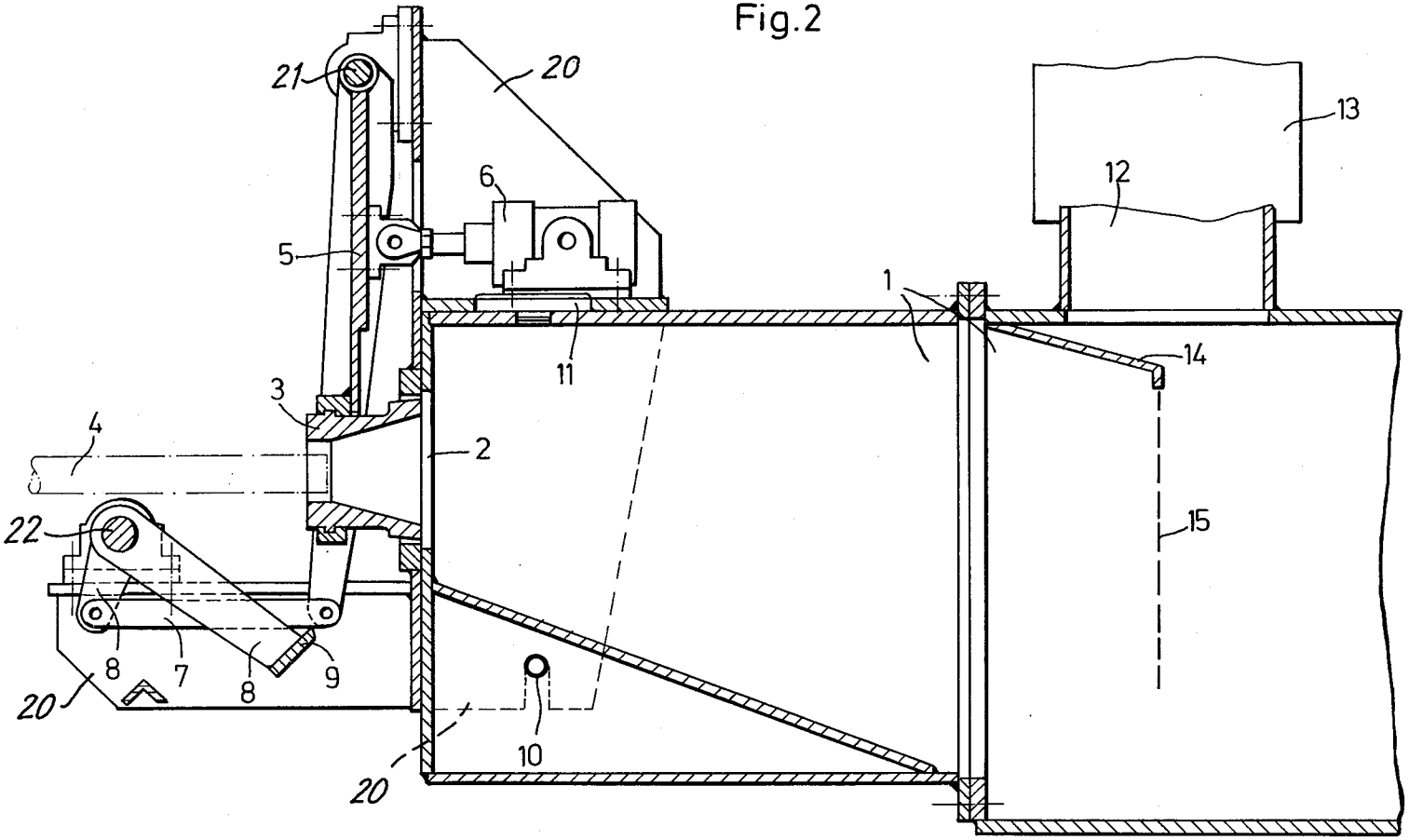
FIG. 2 is a similar view showing the device in working position.

In operation, the equipment has at first a disposition as shown in FIG. 1. Pipes such as 4 are zinc-plated in a known manner, taken out of the bath and placed onto a positioning roller track (not shown). This track moves such a pipe or tube into a position as shown in FIG. 1. The stop 9 is up so that the tube or pipe stops right at the mouthpiece. The pipe may be secured in that position temporarily. Next, the rear end of the pipe (not shown, to the left) is connected to a steam valve and outlet. Also, drive 6 advances its piston rod and pivots the linkage 5 into the position shown in FIG. 2. Accordingly, the cylindrical part of mouthpiece 3 receives the front end of tube 4, and levers 7 and 8 move the stop out of the way.

As steam is applied to the interior of the pipe or tube, zinc-dust vapors are blown into the receptacle 1, to be sucked therefrom or otherwise discharged. Upon completion of purge-blowing, the steam valve is decoupled from the pipe, and the cylinder retracts the piston to thereby pivot the mouthpiece off the pipe. The stop is also returned into the up position to serve as stop for the next pipe.

The pipe just purged can be retracted on the roller track; but it is preferred to provide no further axial movement and to lift it vertically from the track for further handling, processing, etc.

We claim:

1. In a structure serving as an assessory for purging pipes by means of steam blowing, and under noise-attenuating conditions, a receptacle into which steam will be blown upon discharge of such steam from one end of a pipe into whose other end steam has been injected, the receptacle having an opening, the improvement comprising:

a mouthpiece;

linkage means for pivotally suspending the mouthpiece at the opening;

lever means connected to the linkage means and carrying a stop member for selective positioning in front of and away from the opening; and actuator means coupled to the linkage means for placing the mouthpiece over a front end of a pipe adjacent to said opening while removing said stop and, alternatively, pivoting the mouthpiece to clear said front end while causing the stop member to be placed in front of said front end.

2. In a structure as in claim 1, including a frame supporting said lever means, said linkage means, and said actuator means and provided for placement onto the receptacle and thereby suspend the mouthpiece in front of said opening.

* * * * *